United States Patent [19]

Gomez et al.

[11] 4,014,547

[45] Mar. 29, 1977

[54] MATHEMATICAL BOARD GAME

[76] Inventors: Edward Gomez; Charles Gomez, both of 2071 Union Blvd., Bayshore, N.Y. 11706

[22] Filed: Oct. 7, 1975

[21] Appl. No.: 620,296

[52] U.S. Cl. ..... 273/134 C; 273/131 BA; 273/134 GA

[51] Int. Cl.[2] ..... A63F 3/00

[58] Field of Search ..... 273/130, 131, 134, 136

[56] References Cited

UNITED STATES PATENTS

| | | | |
|---|---|---|---|
| 3,356,369 | 12/1967 | Stubbmann | 273/134 GM X |
| 3,762,714 | 10/1973 | Wilson | 273/134 GA |

*Primary Examiner*—Delbert B. Lowe
*Attorney, Agent, or Firm*—Edith Grill

[57] ABSTRACT

A mathematical board game comprising a rotatable playing board having circular pathways of holders for receiving playing pieces and windows for viewing indicia disposed on a bottom number board axially connected therewith; a deck of playing cards bearing the numbers 2 to 9 and the insignia designated on one of the circular pathways; an integral card container centrally located on said playing board for receiving mathematical operation cards which is used by each player in conjunction with his hand of playing cards to determine the positioning of his playing piece.

9 Claims, 13 Drawing Figures

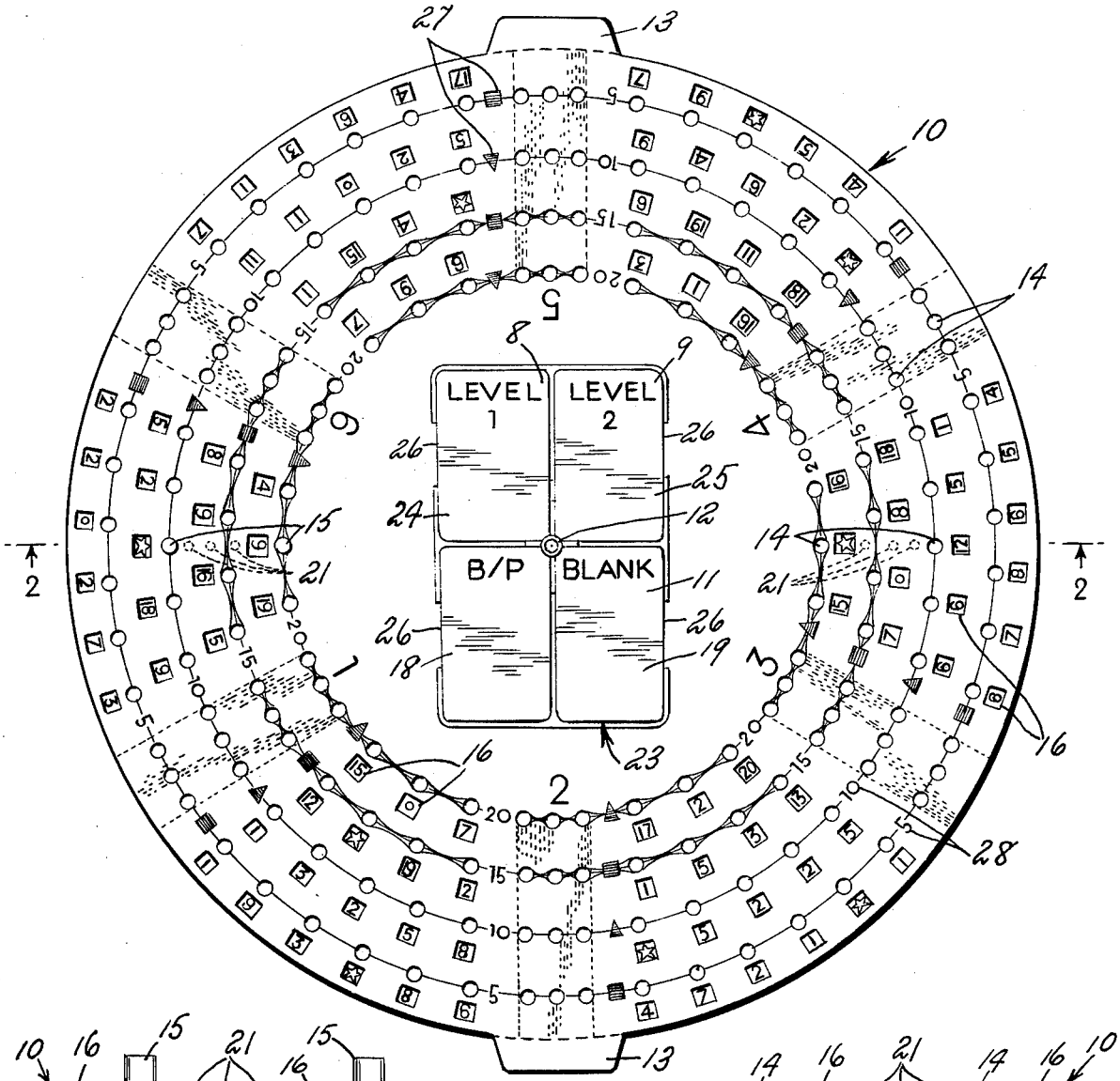
FIG.1
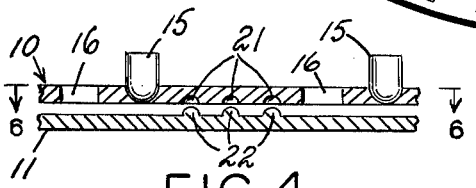
FIG.4
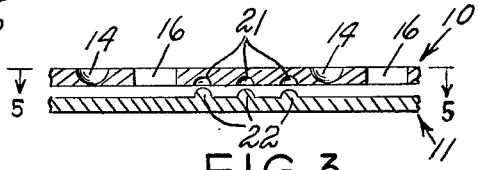
FIG.3
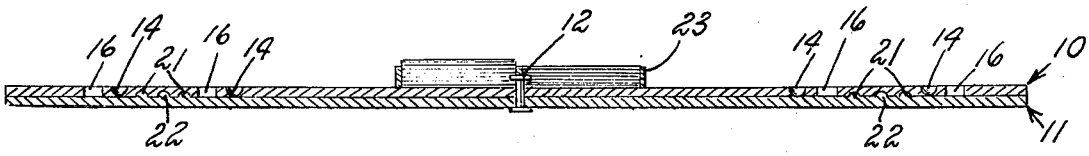
FIG. 2
FIG. 6
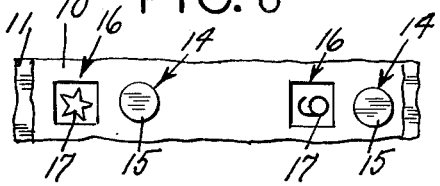
FIG. 5
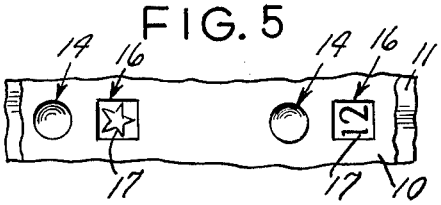

FIG. 7
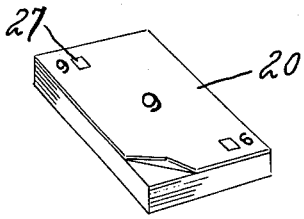
FIG. 8
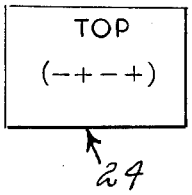
FIG. 9
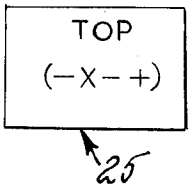
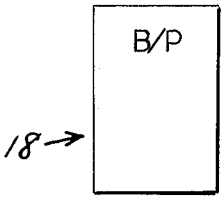
FIG. 10a
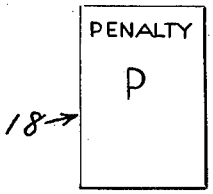
FIG. 10b
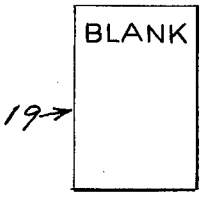
FIG. 11
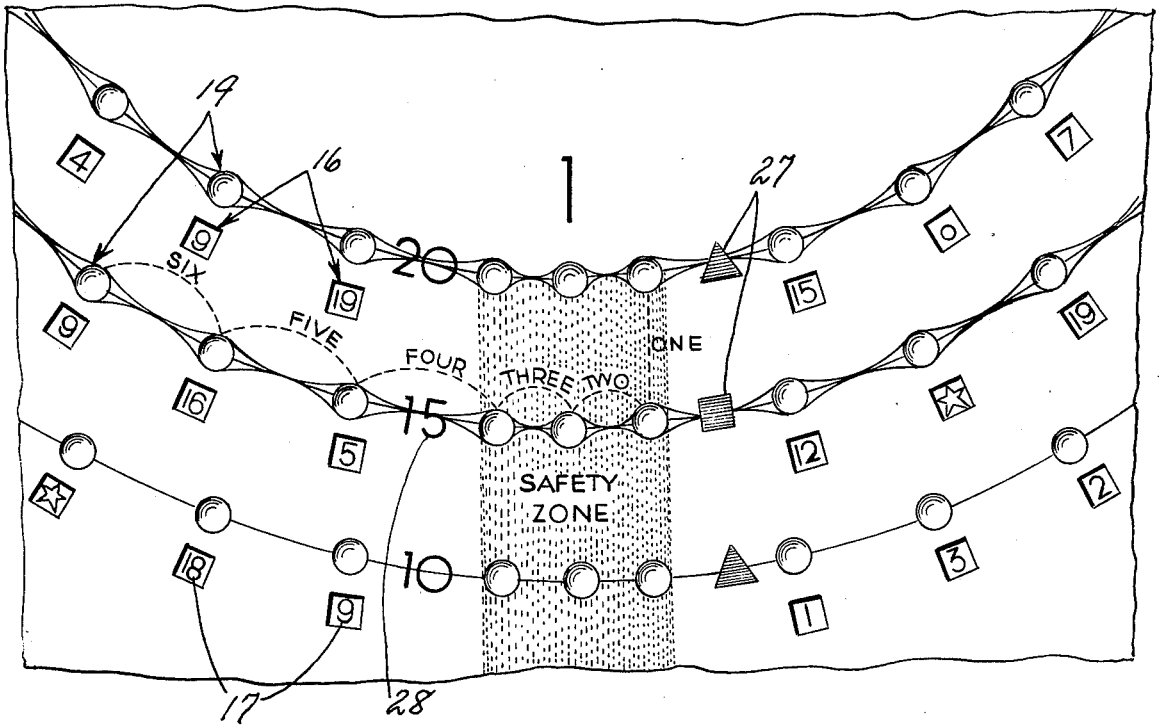
FIG. 12

MATHEMATICAL BOARD GAME

This invention relates to a novel board game which is both entertaining and instructive in developing the mental capabilities to perform mathematical operations such as addition, subtraction, multiplication and division, and which involves both the elements of competition and chance.

Heretofore, board games have relied on pure chance such as the roll of dice or the spin of a wheel to determine the number of spaces that a player moves on a designated track on a playing board. These types of board games are not challenging and do not offer the players any control over their own moves.

It has now been found that the instant invention provides a unique concept in board games, wherein players can control at least 75% of their own moves by arranging a hand of playing cards in any sequence in accordance with the instructions on a mathematical operation card, to arrive at the final numerical answer which controls the number of spaces to be moved. Another unusual feature of the instant invention resides in the scoring, which is not sequential, such that the highest number of spaces moved yields the highest score, but is dependent on indicia associated with each space which vary irregularly in value. The only elements of chance in this game reside in the hand of five playing cards dealt to each player, and in the value associated with each landing position. The rules of the game can be varied to be enjoyable to youngsters of five years of age, as well as adults. The flexibility afforded by this game renders it universally acceptable for all age groups.

Accordingly, the present invention relates to a mathematical game which combines a playing board and playing pieces with playing cards and a mathematical instruction card; said playing board comprising a top disc having viewable apertures superimposed on, and concentrically and rotatably joined to, a number disc bearing assorted indicia inclusive of number score points, stars and dots.

The upper surface of the top disc has a playing surface comprising several circular pathways containing receivers for the playing pieces, each receiver being associated with an indicia appearing through an adjacent aperture or window; six equidistant shaded safety zones which may be color coded or numbered to coincide with the color and/or number of the playing pieces; and a centrally disposed integral container containing compartments for the decks of mathematical instruction cards, the deck of bonus/penalty cards, and the deck of blank cards. The rear surface of the top disc is provided with a plurality of concave depressions which cooperate with a plurality of convex elevations situated on the upper surface of the number disc in order to lock the two discs in position after each rotation. Each circular pathway bears an insignia such as a triangle or a square or other character, which coincides with the characters on the numbered playing cards, and each circular pathway or ring bears a specified bonus number. The rings may be further differentiated by color or design or by other suitable means for playing the game on a child's level (level 1) or on an adult level (level 2) or somewhere in-between.

More specifically, the instant invention relates to a mathematical board game to be played with playing pieces and playing cards comprising a circular playing board superimposed on, and axially interconnected with, a circular/number board in rotatable relation, said playing board being provided with integral holders in designated circular pathways for receiving said playing pieces, each holder being associated with an adjacently disposed opening alignable with viewable indicia disposed on said number board; and an integral card container centrally located on said playing board for receiving at least one deck of mathematical operation cards, the sequential position of each playing piece being determined by the mathematical instructions on the operation card with reference to a set of numbered playing cards.

Therefore, it is a principal object of the instant invention to provide a game which is fun for all age groups.

Another object is to provide a game which permits each player a wide latitude of choice in selecting his move based on the mathematical instruction card and his own playing cards.

Another object is to provide each player with the option to select independently of the other players one of the three methods of winning the game, i.e., by largest number of points, by capturing opponent's playing pieces, or by first player to complete last ring.

Still another object is to provide a mathematical board game wherein the element of chance is minimized.

Still another object is to provide a game which is capable of teaching the mathematical operations of addition, subtraction, multiplication, division and combinations thereof painlessly.

Another object is to enable each player to independently maneuver, manipulate, and finagle his own move, to go forward, backward, utilize a single or pair of playing pieces or play on one or two ring levels, within certain preset rules.

Still another object is to provide a playing board with ever changing conditions effected by rotation of the top board, thereby making each game different.

In accordance with the above objects and such other objects and features which will become apparent from the following specification, the invention will be understood from the accompanying drawings wherein like characters designate like parts and wherein:

FIG. 1 is a top plan view of the mathematical game board of the instant invention.

FIG. 2 is a cross-sectional view through line 2—2 of FIG. 1, showing the top disc superimposed on the bottom disc in locked position.

FIG. 3 is an exploded, fragmentary side view of the instant playing board showing the locking mechanism in aligned position.

FIG. 4 is an exploded fragmentary side view of the instant playing board showing the playing pieces in the receivers.

FIG. 5 is a top perspective view along line 5—5 of FIG. 3, wherein the indicia on the bottom disc are viewable through apertures or windows of the top disc.

FIG. 6 is a top perspective view along line 6—6 of FIG. 4, with indicia appearing through windows.

FIG. 7 is a perspective view of the deck of playing cards.

FIG. 8 is a plan view of the mathematical operation card for level 1.

FIG. 9 is a plan view of the mathematical operation card for level 2.

FIG. 10*a* is a front face view of a Bonus/Penalty card.

FIG. 10*b* is a rear face view of a Bonus/Penalty card.

FIG. 11 is a plan view of a blank card; and

FIG. 12 is a diagrammatic view showing the move from one ring to another ring.

Referring to the drawings in detail, the instant invention comprises a circular playing board 10 superimposed on a circular number board 11 and axially interconnected therewith by pivot means 12 in rotatable relation. Interconnecting pivot means 12 may be a rivet flattened at both ends, as shown in FIG. 2. or other suitable connecting means such as an anchor pin or the like. The above composite game board may be made out of any suitably firm material such as fiberboard, wood, or plastic, with peripherally extending ears 13, integral with playing board 10 as a gripping or grasping means for easy rotation of the board around its axis.

The front face of playing board 10 is provided with integral holders 14 which may be recessed as shown in FIG. 2 or elevated to receive playing pieces 15 which are preferably made out of a hard material such as wood or plastic, and may be in the shape of pegs or marbles, or in other suitable shape. Holders 14 are arranged in circular pathways of at least 2 rings, preferably 4 rings as shown in FIG. 1. However, 6 or 8 rings are also contemplated, said additional rings prolonging the duration of the game.

Playing board 10 is additionally provided with openings or windows 16 which are alignable with indicia 17 disposed on the front face of number disc 11, indicia 17 being a number point score, a star or a dot. Indicia 17 are viewable through openings 16 adjacent to and associated with each holder 14 to provide a player landing thereon with a point score, or a star which instructs the player to draw a Bonus/Penalty card 18, or a dot which instructs the player to draw a blank card 19, which is a wild card and can be used by the player in lieu of one of his playing cards 20.

The rear face of playing board 10 is provided with at least one and preferably more than one concave depression 21 which intimately cooperates with a similar number of convex elevations 22 situated on the front face of number board 11 as shown in FIGS. 3 and 4 to function as a locking means after each rotation. FIG. 2 shows the two circular boards in locked position so that indicia 17, viewable through windows 16, remain fixed for the duration of the game or for a single round, as desired. Thereafter, top disc 10 is lifted by means of ears 13 and rotated so that other indicia 17 are aligned with and viewable through windows 16. Locking means other than sets of cooperating concave depressions and convex elevations may be utilized, such as a releasable anchor pin, centrally located, and the like.

The front face of playing board 10 is additionally provided with an integral container 23 having compartments for Bonus/Penalty cards 18, Blank cards 19, Level 1 operation cards 24, and Level 2 operation cards 25, said card container 23 being centrally located on playing board 10. Card container 23 is preferably provided with openings 26 for easy removal of the cards from the decks situated in the various compartments thereof.

The front face of playing board 10 has printed thereon six equidistant safety zone areas 1, 2, 3, 4, 5 and 6, 60° apart, which may be numbered and/or color coded to identify with the number and/or color of playing pieces 15 which are used either singly or in pairs in playing the game. Other means of identifying the saftey zones with the playing pieces may be utilized, such as design, shape, etc. Each safety zone is the only starting point for the playing piece coded therewith, is also the only area from which a player can move his playing piece to the ring directly below, and is the only area where his playing piece cannot be captured. The game may be modified and simplified by permitting all odd-numbered playing pieces to be safe on all odd-numbered safety zones. Each ring is further identified with a geometric insignia 27 such as a square or a triangle which may be additionally color coded to identify with the insignia and/or color on playing cards 20 which are numbered from 2 to 9. Number 1 is not used because it makes the mathematical operation too simple and numbers above 9 would render said mental calculations too difficult and take the fun out of the game. A playing deck containing forty or more cards numbered 2 to 9 is preferable. Although FIG. 1 shows squares and triangles, other insignia may be utilized, such as clubs, diamonds, spades, hearts, circles, arcs, cubes, pyramids, etc.

A player must have two playing cards with the required insignia for the next ring in order to move to said ring, the move being clockwise as shown in FIG. 12 by the broken lines. Specifically note the broken line labeled ONE going from the innermost ring down to the next ring.

A bold face bonus number 28 is assigned to each ring, having a point value, and is stamped onto the front face of playing board 10 adjacent the safety zones. At the conclusion of the game, if a player has selected the highest scoring method of winning, each player adds the bonus number 28 assigned to that ring wherein his peg 15 has finally landed, to his total score. If two pegs are used during the game, the bonus number for each ring is added to the score. If both pegs are on the same ring, then the bonus number for that ring is added twice to the total score.

The playing surface of disc 10 may differentiate game level 1 rings, which consist of the two innermost rings, from level 2 rings which consist of the two outermost rings, by color and/or design, as shown in FIG. 1. In lieu of 2 rings per each level, 3 or more rings may be utilized for each game level. Similarly, a game board with one game level is also contemplated. Game level 1 utilizes a deck of level 1 operation cards 24, which recite simple mathematical instructions, comprising mostly subtraction and addition such as (—+—+), (+—+—)ODD, (×—+—), and the like. Game level 2 utilizes a deck of level 2 operation cards 25 which recite more complex mathematical instructions such as (—+×÷), [+(Divide total by 3)+×—], [(mult. 2 cards)-+OR—(divide 2 cards)+OR-Last—card], and the like. Each player may arrange his hand of playing cards in any sequence to perform the mathematical operations specified on the upturned and/or selected operation card in order to arrive at a solution, as more specifically described in the following paragraph.

This game is designed for two to six players seated around the board so that play proceeds clockwise from one player to the next. The order in which the players make their moves is selected by lot by any convenient means. For example, a first dealer shuffles playing cards 20 and deals 5 cards to each player. The dealer then turns one of the level 1 operation cards face up in its compartment in the centrally located card tray, and presets a two-minute audio-timer. Each player, using the formula or instructions on the upturned operation card, determines, to the best of his ability, the highest possible number attainable utilizing his own five playing cards. When the time bell rings at the end of two minutes, all the playing cards are placed face down, and each player, in turn, starting with the first player to the left of the dealer, upturns his hand and illustrates his solution to the problem. Utilizing the operation card (+−+−), the following solutions are obtainable using the following hands:

| | |
|---|---|
| Hand I: | 7, 7, 3, 2, 2 |
| Solution: | $7+3=10-2=8+7=15-2=13$ |
| Hand II: | 2, 7, 6, 5, 9 |
| Solution: | $9+7=16-2=14+6=20-5=15$ |
| Hand III: | 2, 2, 7, 2, 8 |
| Solution: | $8+7=15-2=13+2=15-2=13$ |

The player with the highest solution number is first, the next highest is second, and so on. In the case of a tie, as in Hands I and III, the player closest to the dealer's left goes first. Each player retains his own playing cards and is given a pair of appropriately numbered pegs (if numbered pegs are used). The pegs may be distinguished by color or shape in lieu of, or in addition to, number.

Play begins on the innermost circle, with each player starting from a peg holder situated in his own safety zone which is color- and/or number-coded to identify with the coded pegs, by placing one of his pegs into a peg holder situated thereon. The dealer turns another card from the deck of level 1 operation cards face up, the timer is reset and each player uses his originally dealt cards to arrive at a solution to the new mathematical formula. At the end of the two minute time, the bell rings and the players place their cards face down, with the first player exposing his cards and moving his peg clockwise in accordance with his solution number on said circular pathway. The first player must have at least two cards bearing the same insignia (triangles, etc.) as the first circle or ring in order to start the game. Otherwise he forfeits his turn and the next player having matching insignia starts the game. This same rule applies when moving into another circle or ring. Each player in the aforementioned order takes his turn and moves his peg in accordance with his own solution. After all the players have completed their moves, each hand of playing cards is passed clockwise to the player on the left and a new operation card is turned face up. Each player acts upon the new operation card with reference to his own hand of five cards and the game proceeds as before until the players receive their originally dealt cards which signifies the end of one round. The playing cards are collected and reshuffled by the next dealer who is on the left of the first dealer and the game proceeds as above.

Each player has the option to play with one or two pegs by placing his second peg into the game only after his first peg has left the first playing ring and announcing this choice to the other players. The second peg starts from the coded safety zone in the same manner as the first peg. The option to play with one or two pegs is particular to each player regardless of the choices of the other players. Thus, a game may proceed with two players using two pegs each and three players using one peg each. However, each player can move only one peg at a time, except in split moves, using the appropriate level operation card for the corresponding ring level. As the game proceeds, both a level 1 operation card and a level 2 operation card may be simultaneously turned face up to accomodate players on both ring levels. Players with pegs on both levels 1 and 2 may use either operation card 1 to move a peg on a level 1 ring or operation card 2 to move a peg on a level 2 ring. Operation card 2 must be used to move from a level 1 ring to a level 2 ring.

On level 1 rings, players can only move forward (clockwise), whereas level 2 rings permit either forward or backward (counterclockwise) moves. Similarly, opponent's pegs can only be captured in level 2 rings when landing on opponent's peg position. Opponent's peg is removed from the game and the player is on his way to winning the game utilizing method I which requires that you capture at least one peg from each of the other players. In level 1 rings, if a player lands on opponent's peg position, he forfeits his move and must return to the position from which this play originated. Split moves are permitted only on level 2 rings when the player is playing with two pegs. For example, if his solution number is 9, he can move one peg four spaces, as defined by peg holders 14, forward and move the other peg five spaces backward. However, no peg may be captured in a split move.

Associated with each peg position are indicia such as a point score, a star or a colored dot, appearing through a window adjacent thereto, which vary as the playing board is rotated and locked into a new position. The board may be rotated at the end of each game or at the end of each round, as preferred. After each player moves his peg the number of spaces corresponding to the problem solution number he adds the point score associated therewith to his total score.

If a star is associated with a player's landing place, he takes the top card from the Bonus/Penalty deck. A bonus card offers a player the option of adding 15 points to his total score or moving his peg nine additional spaces forward and adding the point score associated therewith to his total score. After a player makes his move, he returns the Bonus/Penalty card to the bottom of the deck. If a player has selected Method II of winning, which requires that he be the first player to complete the last ring with both pegs in his own safety zone, he would probably elect to move nine additional spaces. A penalty card offers a player the option of moving his peg back nine spaces without adding the value of said space to his score, or deducting 20 points from his score. Should there be an opponent's peg nine spaces back, the player cannot exercise his option to move back but must take a 20 point deduction/in his score.

A colored dot in the window adjacent the peg landing space instructs the player to pick a blank card from the deck of blank cards which is valuable and can be used at any time during the game as a substitute card for one of the player's dealt cards. Aforesaid blank card can assume any numerical value from 2 to 9 and any insignia (triangle or square) in order to assist the player in finding the optimum solution to a mathematical problem recited in the upturned operation card. It can only be used once and is then returned to the deck.

When a player utilizes method III of winning, which requires that a player have the highest point score after completing the last ring with one peg finishing in his own safety zone; the bold-face bonus points printed directly on the playing board on each circle are added to the score of each player for each peg situated thereon. For example, if a player has one peg on the innermost circle, 20 points are added to the score; one peg on the innermost circle and one peg on the next circle add 20 + 15 or 35 points to the score; two pegs on the circle bearing the score 10 add 2(10) or 20 points to the total score; and so on.

Moving from one ring to another requires that the player have completed the circular pathway of the instant ring, his peg is back in his own safety zone, and he has at least two playing cards bearing the insignia for the next ring. The player moves his peg directly down into the next circle and then moves clockwise, as shown in FIG. 12, the required number of spaces.

Each player may independently select his method of winning the game and proceed accordingly. He may also change from one method to another during the game. If he finds he is speeding around the circular course, he may decide to use method II and be the first to complete all the rings with his two pegs in his own safety zone. During the game, however, if he finds he has accumulated lots of scoring points, he may change to method III and end the game when one of his pegs has completed the circular pathways, and then proceed to add up the total point score. Then again, a player who has decided on Method II finds that he has captured an opponent's peg and decides to change to winning Method I.

Although a two minute interval is specified herein as the time within which the players must solve the mathematical operations set forth, other time limits may be set as found desirable, inclusive of no time limit. Similarly, any timing device can be used including visual means; however, a timing device having an audio signal means is preferred, such as a buzzer or a bell.

The rules of the game are adjustable and may be altered to provide for a shorter game. By limiting each player to one playing piece, the duration of play of the game is decreased and only Methods I and III of winning are available. Another shortened version of this game comprises the use of only one ring in each ring level instead of the two rings per level, as shown in FIG. 1. Still another means of shortening the game which also simplifies it entails the elimination of level 2 operation cards. Thus, it is apparent that this game is easily and readily adaptable to be suitable for all age levels, as well as for any time limits.

The essence of this game is to provide each player with the opportunity to manipulate his hand of playing cards within the parameter of a mathematical operation card so as to maneuver his playing pieces or piece into designated positions on the board in an attempt to win the game. The changing conditions on the board effected by the other players add challenge to the game and enable each player to finagle his move to fit each changing mode of winning. A certain degree of strategy and excitement pervades the game since each player independently may change his mode of winning as many times as he wishes during the progress of the game. Thus, it is apparent that the wide variety of modifications provided by this game make it suitable as an educational assistance toy for children to learn basic arithmetic calculations including addition, subtraction, multiplication, and division, as well as an entertaining game for adults requiring rapid mental mathematical calculations.

Although this invention has been described with reference to specific embodiments, it will be apparent to one skilled in the art that various modifications and equivalents may be made thereto which fall within the scope herein.

What is claimed:

1. A mathematical board game to be played with playing pieces and playing cards comprising a circular playing board superimposed on, and axially interconnected with, a circular number board in relatively rotatable relation, said playing board being provided with integral holders in designated circular pathways for receiving said playing pieces, each holder being associated with an adjacently disposed opening alignable with viewable indicia disposed on said number board; and an integral card container centrally located on said playing board for receiving at least one deck of mathematical operation cards.

2. A mathematical game in accordance with claim 1, wherein said playing board comprises four circular pathways, the two innermost circles being differentiated from the two outermost circles.

3. A mathematical game in accordance with claim 2, wherein the playing board has demarked six equidistant safety zone areas situated on the four circular pathways and coded to identify with the playing pieces.

4. A mathematical board game in accordance with claim 1, additionally provided with a locking means for fixedly positioning said indicia and locking the number board in a fixed position relative to the playing board, after each rotation.

5. A mathematical board game in accordance with claim 4, wherein said locking means comprises the cooperation of concave depressions on the rear surface of the playing board with convex elevations on the upper surface of the number board.

6. A mathematical board game in accordance with claim 4, wherein said playing board is additionally provided with an integral peripherally extending means for rotating said board.

7. A mathematical game in accordance with claim 2 which includes playing cards and wherein each circular pathway is identified with a geometric insignia to match the insignia on the playing cards.

8. A mathematical game in accordance with claim 7, wherein each circular pathway has a bonus number printed thereon.

9. A mathematical game in accordance with claim 8, wherein the indicia comprise a numeral, a dot and a star.

* * * * *